US010421934B2

(12) United States Patent
Christensen

(10) Patent No.: US 10,421,934 B2
(45) Date of Patent: Sep. 24, 2019

(54) METHODS FOR MAKING SOAP POWDER

(71) Applicant: Onoriode Blessing Oniovomena Christensen, Södertälje (SE)

(72) Inventor: Onoriode Blessing Oniovomena Christensen, Södertälje (SE)

( * ) Notice: Subject to any disclaimer, the term of this patent is extended or adjusted under 35 U.S.C. 154(b) by 0 days.

(21) Appl. No.: 15/263,389

(22) Filed: Sep. 13, 2016

(65) Prior Publication Data

US 2016/0376536 A1 Dec. 29, 2016

(51) Int. Cl.

| | |
|---|---|
| ***C11D 17/06*** | (2006.01) |
| ***C11D 13/02*** | (2006.01) |
| ***C11D 13/10*** | (2006.01) |
| ***C11D 13/12*** | (2006.01) |
| ***C11D 9/02*** | (2006.01) |
| ***C11B 1/00*** | (2006.01) |
| ***C11D 13/00*** | (2006.01) |
| ***C11D 13/20*** | (2006.01) |
| ***C11D 1/00*** | (2006.01) |

(52) U.S. Cl.

CPC ..... *C11D 17/06* (2013.01); *C11D 1/00* (2013.01); *C11D 9/02* (2013.01); *C11D 13/00* (2013.01); *C11D 13/02* (2013.01); *C11D 13/10* (2013.01); *C11D 13/12* (2013.01); *C11D 13/20* (2013.01)

(58) Field of Classification Search

CPC ..... C11D 17/06; C11D 13/20; C11D 13/00; C11D 9/02; C11D 13/12; C11D 13/10; C11D 13/02; C11B 1/00

USPC ..... 554/156

See application file for complete search history.

(56) References Cited

U.S. PATENT DOCUMENTS 3,886,087 A * 5/1975 Terry ..... C11D 13/20 510/345

OTHER PUBLICATIONS

SN7601 Spis (Cooktop specification).

* cited by examiner

*Primary Examiner* — Deborah D Carr

(57) ABSTRACT

Methods for making soap powder of the current invention using a double boiler system in which the direct heating and boiling of the mixture was avoided. A method for making soap powder of the current invention at room temperature. The soap powders of the current invention of a preferred starting composition of 49 g sodium hydroxide, 250 ml vegetable oil, and 220 g water.

11 Claims, No Drawings

METHODS FOR MAKING SOAP POWDER

BACKGROUND

The current Invention explored the discovery of new methods for making soap in the powder form.

Soap making started around 2800 BC. One way in which the earliest people made soap was by combining plants or animals' fats with wood ashes, a method which today still forms the bases for many soap products.

Modern soap products are often made in bar forms, particularly when employing vegetable or animal fats. One disadvantage with this form is that it limits the product to its use as a personal care product rather than as a laundry detergent.

However, powder soap products have been made for many years now, using a wide range of techniques. One common problem with these methods is the high demand of the specification of the materials to be used as well as their numbers to obtain the product. For example, European Pat. No. 1,798,280, involved a soap powder composition of a fatty acid alkali metal salt which comprised further of various special characteristics.

It was earlier disclosed in U.S. Pat. No. 3,886,087 that soap powder could be made from a simple composition of sodium tetraborate, lard, water, and coconut oil in a hot process reaction. The product formed at the end of the reaction had to stand for several days for the final product to form. Besides, this had to undergo crushing to be made into smaller particles, which is subject to dusting soap particles formation.

SUMMARY

The current invention unveiled novel highly economical methods for making soap powder from combining just three ingredients of sodium hydroxide, vegetable oil, and water.

Particularly in contrast to the method in U.S. Pat. No. 3,886,087, these methods include producing dustless granular soap powder directly from the reaction on the heat. Less material are also required than ever before. Moreover, as opposed to heating the reaction to yield the product in the reference invention, the methods of the current invention involved also producing a soap powder at room temperature.

The products formed are two high quality soap powder products that can be used as laundry detergents, or for formulation of other soap products.

DESCRIPTION

The soap powders of the current invention were made from a preferred simple starting composition of equivalent 49 g sodium hydroxide, 250 ml vegetable oil, and 220 g water. However, the methods of the current invention are not limited to these proportions. Particularly as seen in the methods described in Example 8 and 9 below, there is an endless degree to how much the proportion of sodium hydroxide, vegetable oil, and water could be reduced/increased by, if necessary. The products were made as the starting proportion of sodium hydroxide was changed between 45-50 g, the vegetable oil, 250-400 ml, and the water, 220-240 g.

After the first test, which yielded the powder product, further tests were performed to discover faster routes to reach it.

In the first attempts, using heat to speed up the reaction, the initial product formed were soft crumble biscuit-like clumps, which appeared whiter as they cooled and dried. These were easy to press into smaller particles between the finger tips.

In these, a double boiler system consisting of a stainless steel pot held within a wider pan, was used. The mixture was held in the pot and was covered with a plastic film during some instances of the exercise. The pan was filled with water up to half and was heated directly on to heat up the water which transferred its heat to the pot. This was to avoid the direct heating and boiling of the mixture in the pot. The water in the double boiler was refilled to half each time as it evaporated off approaching finish. An Elektro Helios SN7601 cooktop of four cooking plates hob was used as a heat source, and the tests were performed on the largest plate of the four plates. 7 heat levels of 0-6, could be selected with a rotary controller. The heat was maintained at heat level 4, at a temperature of 80-90° C.

Eventually, in the next attempt, leaving the reaction to take place at room temperature, the initial product formed was a white, light-weighted soft mass that was brittle and melting to the press. This dried quickly to form an even whiter, brittle chalk-like mass. Breaking up the mass at the early stage allowed water to evaporate faster from it to give the end product. While this could still be pressed into powder between the finger tips, breaking it up by milling in a mortar made it much easier.

Example 1

| | |
|---|---|
| 24.5 g | Sodium hydroxide |
| 110 g | Water |
| 250 ml | Vegetable oil |

Method

The sodium hydroxide was initially added to the water to dissolve it and the mixture was left to cool to room temperature. The cooled mixture was added to the oil in the pot of the double boiler and the resulting mixture was covered with a plastic film. Heating was initiated at heat level 4 and continued for 1 hour 9 minutes. Next, the mixture was mixed vigorously with a hand mixer until the stage where a sample of the mixture taken and dripped across the surface of the mixture forms visible lines or droplets that remain there for a while before disappearing into the mixture again (medium trace level). Re-covered with the plastic film, the mixture was put back on the heat in the double boiler and heating was resumed at heat level 4. The mixture was mixed thoroughly with a wooden stir stick for approximately 2 minutes, every 15 minutes, until the $5^{th}$ 15 minutes when the heating was stopped and the mixture was left at room temperature for 3 days. After this, 24.5 g sodium hydroxide dissolved in 110 g water was added to the mixture. The resulting mixture was mixed vigorously until it became thick. At this stage, a soapy liquid was observed forming out of it. Next, the mixture was put back in the double boiler and heating was resumed at heat level 4. The mixture was mixed thoroughly for approximately 2 minutes, every 15 minutes, until it became dry. Once cooled, the product formed was very soft crumble biscuit-like clumps that broke down easily into smaller powder granules by a slight press with a finger. These were separated into smaller granules with the stir stick and left to dry further at room temperature for 2 days.

Final product: white, soft powder granules

Comments

This was the initial test in which the first powder product was made. However, the steps involved were considered time consuming that a faster route was desired.

Example 2

| | |
|---|---|
| 24.5 g | Sodium hydroxide |
| 110 g | Water |
| 250 ml | Vegetable oil |

Method

The sodium hydroxide was initially added to the water to dissolve it and the mixture was left to cool to room temperature. The cooled mixture was added to the oil in the pot of the double boiler and the resulting mixture was covered with a plastic film. Heating was initiated at heat level 4 and continued for 1 hour 9 minutes. Next, the mixture was mixed vigorously with a hand mixer until a medium trace mixture was reached. Viewing a sample of the mixture taken with a stainless steel spoon at this stage, showed there was no separation between the oil and the water phase. The mixture was put back on the heat in the double boiler at heat level 4. It was mixed thoroughly with a wooden stir stick for approximately 2 minutes, every 15 minutes, until the $5^{th}$ 15 minutes when the heating was stopped and the mixture was left at room temperature for approximately 3 days. After this 24.5 g sodium hydroxide dissolved in 110 g water was added to the mixture. The resulting mixture was mixed vigorously until it became thick. At this stage, a soapy liquid was observed forming out of it. Next, the mixture was put back in the double boiler and heating was resumed at heat level 4. The mixture was checked and mixed thoroughly for approximately 2 minutes, every 15 minutes, until it became dry. It was covered with a plastic film only for the first two 15 minutes. Once cooled, the product formed was very soft crumble biscuit-like clumps that broke down easily into smaller powder granules by a slight press with a finger. These were separated into smaller granules with the stir stick and were left to dry further at room temperature for 2 days.

Final product: white, soft powder granules

Comments

Repeating the test done in example 1 above, this time the mixture was covered only for the first two 15 minutes of reheating in the double boiler to see how this might affect the final product. The product formed was similar to that formed in the previous example.

Example 3

| | |
|---|---|
| 49 g | Sodium hydroxide |
| 220 g | Water |
| 250 ml | Vegetable oil |

Method

The sodium hydroxide was initially added to the water to dissolve it and the mixture was left to cool to room temperature. The cooled mixture was added to the oil in a mixing bowl. The resulting mixture was mixed with a hand mixer until a uniform texture mixture was reached. Viewing a sample of the mixture taken with a stainless steel spoon at this stage, showed there was no separation between the oil and the water phase. The mixture was mixed further for 5 minutes and was left overnight for 19 hours. A very thick creamy mixture was formed the next day, and there was a slight separation between the oil and the liquid phases. The mixture was mixed further for 3 minutes. Covered with a plastic film, the mixture was put on the heat in the double boiler at heat level 4. It was mixed thoroughly with a wooden stir stick for approximately 2 minutes, every 15 minutes, until it became dry. Once cooled, the product formed was very soft crumble biscuit-like clumps that broke down easily into smaller powder granules by a slight press with a finger. These were separated into smaller granules with the stir stick and were left to dry further at room temperature for 2 days.

Final product: white, soft powder granules

Comments

Carrying on from the previous examples, the equivalent proportion of sodium hydroxide, water, and oil were combined together from the start of the test. The purpose of this exercise was also to see how removing the initial heating of 1 hour 9 minutes would affect the final product. Surprisingly, no soapy liquid was observed forming out of the mixture, not even when the test was repeated doing the mixing for a longer period of time. It was recorded, therefore, that the steps avoided in the previous examples, 1 and 2, must have aided the soapy liquid formation in the first place. In spite this, the same product as was formed in the previous examples was also formed.

This test also helped to identify at what stage to stop mixing the mixture in the initial part, as this was particularly hard to determine by sight as the mixture had a similar look throughout most times of the mixing. It was observed that the mixture came to a stage where it changed from a very light liquid form to a thicker form of a uniform texture. A spoon test was conducted to confirm this which showed there was no separation between the oil and the water phase of the mixture at this stage. Mixing the mixture with breaks of approximately 20 minutes in between the total mixing time allowed it to thicken up quickly to get to this stage.

Example 4

| | |
|---|---|
| 49 g | Sodium hydroxide |
| 220 g | Water |
| 250 ml | Vegetable oil |

Method

The sodium hydroxide was initially added to the water to dissolve it and the mixture was left to cool to room temperature. The cooled mixture was added to the oil in the pot of the double boiler and the resulting mixture was covered with a plastic film. Heating was initiated at heat level 4 and continued for 1 hour 9 minutes. Next, the mixture was mixed vigorously with a hand mixer for approximately 22 minutes until a uniform texture mixture was reached. Viewing a sample of the mixture taken with a stainless steel spoon at this stage, showed there was no separation between the oil and the water phase. The mixture was mixed further for 5 minutes and was left overnight for 19 hours. A very thick mixture with little oil on top was formed the next day. The oil was removed by mixing for 3 minutes. Covered with a plastic film, the mixture was put back on the heat in the double boiler and heating was resumed at heat level 4. It was mixed thoroughly with a wooden stir stick for approximately 2 minutes, every 15 minutes, until it became dry. Once cooled, the product formed was very soft crumble biscuit-like clumps that broke down easily into smaller powder granules by a slight press with a finger. These were separated into smaller granules with the stir stick and were left to dry further at room temperature for 2 days.

Final product: white, soft powder granules

In the following examples, 5-9, saponification was brought to the maximum by the adding of extra water to the mixture as the water of the initial reaction had evaporated.

Example 5

| | |
|---|---|
| 49 g | Sodium hydroxide |
| 220 g | Water |
| 250 ml | Vegetable oil |

Method

The sodium hydroxide was initially added to the water to dissolve it and the mixture was left to cool to room temperature. The cooled mixture was added to the oil. The resulting mixture was mixed with a hand mixer for 29 minutes until a uniform texture mixture was reached. Viewing a sample of the mixture taken with a stainless steel spoon at this stage, showed there was no separation between the oil and the water phase. The mixture was mixed further for 5 minutes and then left overnight. A very thick mixture was formed the next day. Covered with a double layer of plastic film, the mixture was put on the heat in the double boiler at heat level 4. It was mixed thoroughly for approximately 2 minutes, every 15 minutes.

As a way to determine when the product was ready, a sample was taken each time and left to cool to room temperature. The sample cooled to form a clump. The clump was examined for small white granular solids formed throughout its mass. As the product was near ready, these were expected to become clearer and the clump much firmer, having no buttery feel or any sticky liquid around it or in its centre. Fully ready, a firm, soft crumble biscuit-like clump that broke down easily into smaller powder granules by a slight press with a finger was expected to form.

As the mixture was almost dry, a sample taken cooled to form a hard clump. As a result, 200 g of water was added to the mixture and was mixed well with it. Heating was continued in the double boiler with the mixture covered with the double layer of plastic film. The mixing every 15 minutes for approximately 2 minutes was continued until a firm, soft crumble biscuit-like clump that broke down easily into smaller powder granules by a slight press with a finger was obtained. At this stage, the double layer of plastic film was removed for the water to evaporate faster. No further mixing was done to the mixture until it became dry. A white/yellow mashed potatoes-like product was formed as the mixture had dried. Once cooled, the product returned to the state of the last sample taken. The clumps were separated into smaller granules with the stir stick and were left to dry further at room temperature for 2 days.

Final product: white, soft powder granules

Example 6

| | |
|---|---|
| 49 g | Sodium hydroxide |
| 220 g | Water |
| 250 ml | Vegetable oil |

Method

The sodium hydroxide was initially added to the water to dissolve it and the mixture was left to cool to room temperature. The cooled mixture was added to the oil in the pot of the double boiler and the resulting mixture was covered with a plastic film. Heating was initiated at heat level 4 and continued for 1 hour 9 minutes. Next, the mixture was mixed vigorously with a hand mixer for approximately 9 minutes until a uniform texture mixture was reached. Viewing a sample of the mixture taken with a stainless steel spoon at this stage, showed there was no separation between the oil and the water phase. The mixture was mixed further for 5 minutes. Covered with a double layer of plastic film, it was put back on the heat in the double boiler at heat level 4. The mixture was checked and mixed thoroughly with a wooden stir stick for approximately 2 minutes, every 15 minutes, until it became too thick to mix. A thick, gel-like mixture was formed. 100 g of water was added to it and mixed well with it. The heating was continued in the double boiler with the mixture covered with the double layer of plastic film. The mixture was checked and mixed thoroughly with a wooden stir stick for approximately 2 minutes, every 30 minutes.

As a way to determine when the product was ready, a sample was taken each time and left to cool to room temperature. The sample cooled to form a clump. The clump was examined for small white granular solids formed throughout its mass. As the product was near ready, these were expected to become clearer and the clump much firmer, having no buttery feel or any sticky liquid around it or in its centre. Fully ready, a firm, soft crumble biscuit-like clump that broke down easily into smaller powder granules by a slight press with a finger was expected to form.

As the first water had almost completely evaporated, 100 g more water was added to the mixture and mixed well with it. The heating and mixing every 15 minutes for approximately 2 minutes was continued until a firm, soft crumble biscuit-like sample clump that broke down easily into smaller powder granules by a slight press with a finger was obtained. At this stage, the double layer of plastic film was removed for the water to evaporate faster. No further mixing was done to the mixture until it became dry. A slightly yellow, thick mashed potatoes-like product was formed. Once cooled, this returned to the state of the last sample taken. The clumps were separated into smaller granules with the stir stick and were left to dry further at room temperature for 2 days.

Final product: white, soft powder granules

Example 7

| | |
|---|---|
| 49 g | Sodium hydroxide |
| 220 g | Water |
| 250 ml | Vegetable oil |

Method

The sodium hydroxide was initially added to the water to dissolve it and the mixture was left to cool to room temperature. The cooled mixture was added to the oil. The resulting mixture was mixed with a hand mixer for 35 minutes until a uniform texture mixture was reached. Viewing a sample taken with a stainless steel spoon at this stage showed there was no separation between the oil and the water phase of the mixture. The mixture was mixed further for 5 minutes. Covered with a double layer of plastic film, the mixture was put on the heat in the double boiler at heat level 4. The mixture was checked and mixed thoroughly with a wooden stir stick for approximately 2 minutes, every 15 minutes, until a thick yellow, jelly soup-like mixture was form. At this stage, 200 g of water was added to it and was mixed well with it. Heating was continued in the double boiler with the mixture covered with the double layer of plastic film. It was checked and mixed thoroughly with the wooden stir stick for approximately 2 minutes, every 15 minutes.

As a way to determine when the product was ready, a sample was taken each time and left to cool to room temperature. The sample cooled to form a clump. The clump was examined for small white granular solids formed throughout its mass. As the product was near ready, these were expected to become clearer and the clump much firmer, having no buttery feel or any sticky liquid around it or in its centre. Fully ready, a firm, soft crumble biscuit-like clump that broke down easily into smaller powder granules by a slight press with a finger was expected to form.

Until this was obtained, the mixing every 15 minutes for approximately 2 minutes was continued. At this stage, the double layer of plastic film was removed from the pot for the water to evaporate faster. No further mixing was done to the mixture until it became dry. As the mixture had dried, a slightly yellow thick mashed potatoes-like product was formed. Once cooled, the product returned to the state of the last sample taken. The clumps were separated into smaller granules with the stir stick and were left to dry further at room temperature for 2 days.

Final product: white, soft powder granules

Example 8

| | |
|---|---|
| 49 g | Sodium hydroxide |
| 220 g | Water |
| 250 ml | Vegetable oil |

Method

The sodium hydroxide was initially added to the water to dissolve it and the mixture was left to cool to room temperature. The cooled mixture was added to the oil. The resulting mixture was mixed with a hand mixer for 50 minutes until a uniform texture mixture was reached. Viewing a sample of the mixture taken with a stainless steel spoon at this stage, showed there was no separation between the oil and the water phase of the mixture. The mixture was then put on the heat in the double boiler at heat level 4. It was mixed with a wooden stir stick until it became very thick with the appearance of thick custard. 100 g water was added and was mixed well with it. The mixture was covered with a double layer of plastic film and was left on the heat in the double boiler. It was checked and mixed thoroughly with the wooden stir stick for approximately 2 minutes, every 30 minutes.

As a way to determine when the product was ready, a sample was taken each time and left to cool to room temperature. The sample cooled to form a clump. The clump was examined for small white granular solids formed throughout its mass. As the product was near ready, these were expected to become clearer and the clump much firmer, having no buttery feel or any sticky liquid around it or in its centre. Fully ready, a firm, soft crumble biscuit-like clump that broke down easily into smaller powder granules by a slight press with a finger was expected to form.

As the first water had almost completely evaporated, a sample taken at this point cooled to form a hard clump. At this result, 100 g more water was added to the mixture and mixed well with it. Heating was continued in the double boiler with the mixture covered with the double layer of plastic film. The mixing every 30 minutes for approximately 2 minutes was continued until a firm, soft crumble biscuit-like clump that broke down easily into smaller powder granules by a slight press with a finger was obtained. At this stage, the double layer of plastic film was removed from the pot for the water to evaporate faster. No further mixing was done to the mixture until it was dry. A slightly yellow thick mashed potatoes-like product was formed. Once cooled, this returned to the state of the last sample taken. The clumps were separated into smaller granules with the stir stick and were left to dry further at room temperature for 2 days.

Final product: white, soft powder granules

Example 9

| | |
|---|---|
| 49 g | Sodium hydroxide |
| 220 g | Water |
| 250 ml | Vegetable oil |

Method

The sodium hydroxide was initially added to the water to dissolve it and the mixture was left to cool to room temperature. The cooled mixture was added to the oil in the pot of the double boiler and heating was initiated at heat level 4. The mixture was mixed with a wooden stir stick until it became very thick with the appearance of a thick custard. 100 g water was added and was mixed well with it. The mixture was covered with a double layer of plastic film and was left on the heat in the double boiler. It was mixed thoroughly with the wooden stir stick for approximately 2 minutes, every 30 minutes.

As a way to determine when the product was ready, a sample was taken each time and left to cool to room temperature. The sample cooled to form a clump. The clump was examined for small white granular solids formed throughout its mass. As the product was near ready, these were expected to become clearer and the clump much firmer, having no buttery feel or any sticky liquid around it or in its centre. Fully ready, a firm, soft crumble biscuit-like clump that broke down easily into smaller powder granules by a slight press with a finger was expected to form.

As the first water had almost completely evaporated, 100 g more water was added to the mixture and mixed well with it. The heating and mixing every 30 minutes for approximately 2 minutes was continued until a firm, soft crumble biscuit-like sample clump that broke down easily into smaller powder granules by a slight press with a finger was obtained. At this stage, the double layer of plastic film was removed from the pot for the water to evaporate faster. No further mixing was done to the mixture until it was dry. A slightly yellow thick mashed potatoes-like product was formed. Once cooled, this returned to the state of the last sample taken. The clumps were separated into smaller granules with the stir stick and were left to dry further at room temperature for 2 days.

Final product: white, soft powder granules

The following example described the method where the test was performed at room temperature.

Example 10

| | |
|---|---|
| 49 g | Sodium hydroxide |
| 220 g | Water |
| 250 ml | Vegetable oil |

Method

The sodium hydroxide was initially added to the water to dissolve it and the mixture was left to cool to room temperature. The cooled mixture was added to the oil in a mixing bowl. The resulting mixture was mixed with a hand mixer until a uniform texture mixture was reached. Viewing a sample taken with a stainless steel spoon at this stage, showed there was no separation between the oil and the water phase. The mixture was mixed further for 5 minutes and was left overnight for 19 hours. A very thick mixture with little oil on top was formed the next day. The mixture was remixed for 2 minutes to remove the oil. Then it was left to stand at room temperature for one more day. The following day a white, light-weighted, soft soap mass that was brittle and melting to the press had formed. Half of the soap mass was broken up into smaller pieces. The other half with the smaller pieces were spread out to dry at room temperature for 2 more days. They dried to form a white brittle chalk-like soap product. While these could still be pressed into powder between the finger tips, breaking these up by milling in a mortar made it much easier.

What is claimed is:

1. A method for making soap powder wherein Stage 1 involves dissolving 24.5 g sodium hydroxide in 110 g water, adding this mixture to 250 ml vegetable oil, covering the resulting mixture with a plastic film and heating it for 1 hour 9 minutes in a double boiler system, where the direct heating and boiling of the mixture is avoided, mixing the mixture until the stage where a sample of the mixture taken and dripped across the surface of the mixture forms visible lines or droplets that remain there for a while before disappearing into the mixture again, is reached, reheating the mixture in the double boiler while mixing it thoroughly for approximately 2 minutes, in 15 minute interval, stopping the heating at the $5^{th}$ 15 minutes and leaving the mixture to stand at room temperature for 3 days, wherein Stage 2 involves dissolving 24.5 g sodium hydroxide in 110 g water and adding this to the mixture of Stage 1, mixing the resulting mixture until it is thick and a soapy liquid starts to form out of it, reheating this mixture in the double boiler while mixing it for approximately 2 minutes, in 15 minute intervals, until it becomes dry, leaving the dry product to cool to room temperature to form very soft clumps, separating the clumps into smaller granules with any hard material and further drying at room temperature for 2 days.

2. The method of claim 1 wherein the mixture at Stage 2 is covered with a plastic film during the first two 15 minutes of heating it in the double boiler.

3. A method for making soap powder wherein Stage 1 involves dissolving 49 g sodium hydroxide in 220 g water, adding this mixture to 250 ml vegetable oil, wherein Stage 2 involves mixing the resulting mixture until a uniform texture level is reached, at this stage, a sample is taken with a stainless steel spoon to determine there is no separation between the oil and the water phase of the mixture, mixing the mixture further for 5 minutes and letting it stand overnight for 19 hours to form a thick mixture, mixing this further for 3 minutes, covering it with a plastic film and heating it in a double boiler system, where the direct heating and boiling of the mixture is avoided, while mixing it thoroughly for approximately 2 minutes, in 15 minute intervals, until it becomes dry, leaving the dry product to cool to room temperature to form very soft clumps, separating the clumps with any hard material into smaller granules and drying at room temperature for 2 days.

4. The method according to claim 3 wherein the mixture at the end of Stage 1 is heated in the double boiler for 1 hour 9 minutes.

5. A method for making soap powder wherein Stage 1 involves dissolving 45 to 50 g sodium hydroxide in 220 to 240 g water, adding this mixture to 250 to 400 ml vegetable oil, covering the resulting mixture with a plastic film and heating it for 1 hour 9 minutes in a double boiler system, where the direct heating and boiling of the mixture is avoided, mixing the mixture vigorously until a uniform texture level is reached, at this stage, a sample is taken with a stainless steel spoon to determine there is no separation between the oil and the water phase of the mixture, mixing the mixture further for 5 minutes, wherein Stage 2 involves covering the mixture with a double layer of plastic film and reheating it in the double boiler while mixing it thoroughly for approximately 2 minutes, in 15 minute intervals, until it becomes too thick to mix, at which stage a thick, gel-like mixture is formed, adding and mixing in 100 g water to the mixture and continuing heating it in the double boiler while covering it with a double layer of plastic film and mixing it thoroughly for approximately 2 minutes, in 30 minutes-intervals, taking a sample each time to determine when the product is ready by letting the sample cool to room temperature to form a clump, examining the clump for small white granular solids formed throughout its mass, whereas fully ready, a firm, soft clump that breaks down easily into smaller powder granules is formed, wherein Stage 3 involves adding and mixing in up to 100 g or more water to the mixture, continue heating the mixture in the double boiler while mixing it for approximately 2 minutes, in 15 minute intervals, until a firm, soft sample clump that breaks down easily into smaller powder granules is obtained, at which stage, removing the double layer of plastic film in order for the water to evaporate faster, and without mixing it any further, letting the mixture to dry on the heat to form a slightly yellow thick product which cools to take the form of, a firm, soft clump that breaks down easily into smaller powder granules, separating the clumps into smaller granules with any hard material and drying at room temperature for 2 days.

6. A method for making soap powder wherein Stage 1 involves dissolving 45 to 50 g sodium hydroxide in 220 to 250 g of water, adding this mixture to 250 to 400 ml vegetable oil and mixing the resulting mixture until a uniform texture level is reached, at this stage, a sample is taken with a stainless steel spoon to determine there is no separation between the oil and the water phase of the mixture, mixing the mixture further for 5 minutes and letting it stand overnight to form a very thick mixture, wherein Stage 2 involves covering the mixture with a double layer of plastic film, heating it in a double boiler system, where the direct heating and boiling of the mixture is avoided, while mixing it thoroughly for approximately 2 minutes, in 15 minute intervals, taking a sample each time to determine when the product is ready by letting the sample cool to room temperature to form a clump, examining the clump for small white granular solids formed throughout its mass, whereas fully ready, a firm, soft clump that breaks down easily into smaller powder granules is formed, wherein Stage 3 involves adding and mixing in up to 200 g or more water to the mixture as it is almost dry and a sample taken at this point cools to form a hard clump, continue heating the mixture in the double boiler while covering it with the double layer of plastic film and mixing it after every 15 minutes for approximately 2 minutes, until a firm, soft sample clump that breaks down easily into smaller powder granules is obtained, at which stage, removing the double layer of plastic film in order for the water to evaporate faster, and without any further mixing, letting the mixture to dry on the heat to form a white/yellow product, which cools to take the form of a firm, soft clump that breaks down easily into smaller powder granules, separating the clumps into smaller granules with any hard material and drying at room temperature for 2 days.

7. The method of claim 6 wherein the mixture at the end of Stage 1 after being further mixed for 5 minutes at Stage 2 involves heating the mixture of Stage 1 mixing the mixture for approximately 2 minutes after every 15 minutes only until a thick yellow, jelly soup-like mixture is formed before adding water to the mixture in Stage 3.

8. A method for making soap powder wherein Stage 1 involves dissolving 45 to 50 g sodium hydroxide in 220 to 240 g water, adding this mixture to 250 to 400 ml vegetable oil, mixing the resulting mixture until a uniform texture level is reached, at this stage, a sample is taken with a stainless steel spoon to determine there is no separation between the oil and the water phase of the mixture, heating the mixture in a double boiler system, where the direct heating and boiling of the mixture is avoided, while mixing it until it becomes very thick in appearance, wherein Stage 2 involves adding and mixing in 100 g water to the mixture, covering it with a double layer of plastic film and reheating it in the double boiler system while mixing it thoroughly for approximately 2 minutes, in 30 minute intervals, taking a sample each time to determine when the product is ready by letting the sample cool to room temperature to form a clump, examining the clump for small white granular solids formed throughout its mass, whereas, fully ready, a firm, soft clump that breaks down easily into smaller powder granules is formed, wherein Stage 3 involves adding and mixing in up to 100 g or more water to the mixture upon noticing that a hard clump is formed as the first water added has almost completely evaporated continue heating the mixture in the double boiler while covering it with the double layer of plastic film and mixing it for approximately 2 minutes, in 30 minute intervals, until a firm, soft clump that breaks down easily into smaller powder granules is obtained, at which stage, removing the double layer of plastic film in order for the water to evaporate faster, and without any further mixing, letting the mixture to dry on the heat to form a slightly yellow thick product, which cools to take the form of a firm, soft clump that breaks down easily into smaller powder granules, separating the clumps into smaller granules with any hard material and drying at room temperature for 2 days.

9. The method of claim 8 wherein without doing any mixing to the mixture at Stage 1, rather, heating it in the double boiler system while mixing it until a very thick custard-like mixture is formed before adding the 100 g of water in the next stage.

10. The method as in any of the preceding claims wherein the final products are soft powder granules.

11. A method for making soap powder which involves dissolving 49 to 50 g sodium hydroxide in 220 to 230 g water, adding this mixture to 250 ml vegetable oil and mixing the resulting mixture until a uniform texture level is reached, at this stage, a sample is taken with a stainless steel spoon to determine there is no separation between the oil and the water phase of the mixture, mixing the mixture further for 5 minutes and letting it stand overnight for 19 hours to form a very thick mixture with little oil on top, removing this excessive oil by mixing the mixture for 2 minutes, letting the mixture thereafter, to stand at room temperature for one more day to form a white, light-weighted, soft soap mass that is brittle and melting to the press, breaking up the mass and drying the pieces further at room temperature for 2 more days to form light-weighted, brittle chalk-like soap pieces, breaking the pieces further down and milling into powder.

* * * * *